US010976115B2

(12) United States Patent
Gotterbarm et al.

(10) Patent No.: US 10,976,115 B2
(45) Date of Patent: Apr. 13, 2021

(54) HEAT EXCHANGER TUBE

(71) Applicant: WIELAND-WERKE AG, Ulm (DE)

(72) Inventors: Achim Gotterbarm, Dornstadt (DE); Ronald Lutz, Blaubeuren (DE); Jean El Hajal, Ulm (DE); Manfred Knab, Dornstadt (DE)

(73) Assignee: WIELAND-WERKE AG, Ulm (DE)

( * ) Notice: Subject to any disclaimer, the term of this patent is extended or adjusted under 35 U.S.C. 154(b) by 184 days.

(21) Appl. No.: 16/098,672

(22) PCT Filed: May 17, 2017

(86) PCT No.: PCT/EP2017/000596
§ 371 (c)(1),
(2) Date: Nov. 2, 2018

(87) PCT Pub. No.: WO2017/207090
PCT Pub. Date: Dec. 7, 2017

(65) Prior Publication Data

US 2019/0145717 A1 May 16, 2019

(30) Foreign Application Priority Data

Jun. 1, 2016 (DE) ..... 10 2016 006 967.8

(51) Int. Cl.
*F28F 7/00* (2006.01)
*F28F 1/36* (2006.01)
(Continued)

(52) U.S. Cl.
CPC ..... *F28F 1/36* (2013.01); *F28F 1/18* (2013.01); *F28F 1/40* (2013.01); *F28F 1/422* (2013.01)

(58) Field of Classification Search
CPC ..... F28F 1/36; F28F 1/18; F28F 1/40; F28F 1/422
(Continued)

(56) References Cited

U.S. PATENT DOCUMENTS 3,696,861 A 10/1972 Webb
3,776,018 A 12/1973 French
(Continued)

FOREIGN PATENT DOCUMENTS

DE 27 58 526 C2 7/1979
DE 33 32 282 A1 3/1984
(Continued)

OTHER PUBLICATIONS

International Search Report issued in Application No. PCT/EP2017/000596 with English translation dated Aug. 16, 2017 (7 pages).
(Continued)

*Primary Examiner* — Claire E Rojohn, III
(74) *Attorney, Agent, or Firm* — Flynn Thiel, P.C.

(57) ABSTRACT

The invention relates to heat exchanger tube having a longitudinal tube axis; axially parallel or helically circumferential continuous fins are formed from the tube wall on the outer tube face and/or inner tube face, and continuous primary grooves are formed between adjacent fins; the fins have at least one structured zone on the outer tube face and/or inner tube face, said structured zone being provided with a plurality of projections which project from the surface an have a height such that the projections are separated by notches. According to the invention, the projections are arranged in groups which are periodically repeated along the extension of the fin. Furthermore, at least two notches between the projections within the group have a varying notch depth in a fin.

16 Claims, 4 Drawing Sheets

(51) Int. Cl.
*F28F 1/40* (2006.01)
*F28F 1/42* (2006.01)
*F28F 1/18* (2006.01)

(58) Field of Classification Search
USPC ..... 165/183
See application file for complete search history.

(56) References Cited

U.S. PATENT DOCUMENTS 4,216,826 A 8/1980 Fujikake
4,549,606 A 10/1985 Sato et al.
4,577,381 A 3/1986 Sato et al.
4,660,630 A 4/1987 Cunningham et al.
4,733,698 A * 3/1988 Sato ..... F28F 1/40 138/38
5,054,548 A 10/1991 Zohler
5,332,034 A * 7/1994 Chiang ..... F28F 1/40 165/184
5,458,191 A * 10/1995 Chiang ..... F28F 1/40 165/133
5,775,411 A 7/1998 Schuez et al.
5,975,196 A * 11/1999 Gaffaney ..... F28F 1/40 165/133
6,182,743 B1 * 2/2001 Bennett ..... F28F 1/40 165/133
6,336,501 B1 * 1/2002 Ishikawa ..... F28F 1/40 165/133
6,427,767 B1 8/2002 Mougin
6,488,078 B2 * 12/2002 Beutler ..... B21C 37/207 165/133
7,311,137 B2 * 12/2007 Thors ..... F28F 1/422 165/133
7,451,542 B2 11/2008 Brand et al.
8,857,505 B2 10/2014 Beutler et al.
9,188,287 B2 * 11/2015 Krautschick ..... F15D 1/004
9,234,709 B2 * 1/2016 Gotterbarm ..... B23P 15/26
2002/0070011 A1 * 6/2002 Itoh ..... F28F 1/40 165/133
2003/0009883 A1 * 1/2003 Thors ..... F28F 1/40 29/890.03
2005/0145377 A1 7/2005 Thors et al.
2006/0112535 A1 * 6/2006 Thors ..... B21J 5/068 29/557
2006/0213346 A1 * 9/2006 Thors ..... B21C 37/158 83/178
2007/0124909 A1 * 6/2007 Thors ..... B21C 37/207 29/428
2007/0193728 A1 * 8/2007 Beutler ..... B21C 37/207 165/133
2007/0234871 A1 * 10/2007 Thors ..... F28F 1/422 83/875
2009/0025222 A1 1/2009 Miyahara
2009/0178432 A1 * 7/2009 Reagen ..... F25B 39/02 62/347
2010/0193170 A1 * 8/2010 Beutler ..... B21C 37/207 165/181
2010/0193171 A1 * 8/2010 Beppu ..... C21D 8/08 165/181
2010/0288480 A1 * 11/2010 Beutler ..... F28F 1/40 165/181
2011/0036553 A1 * 2/2011 Christen ..... F28F 19/006 165/185
2016/0097604 A1 * 4/2016 Reagen ..... F28F 21/084 165/183
2016/0369377 A1 * 12/2016 Somani ..... C22C 21/00

FOREIGN PATENT DOCUMENTS

DE 101 56 374 C1 2/2003
DE 10 2006 008 083 B4 9/2007
DE 603 17 506 T2 9/2008
EP 0 713 072 B1 5/1996
EP 1 830 151 A1 9/2007
JP 10-332292 A 12/1998
WO WO 03/104736 A1 12/2003

OTHER PUBLICATIONS

Written Opinion of International Searching Authority issued in Application No. PCT/EP2017/000596 dated Aug. 16, 2017 (5 pages).
Office Action of German Patent Office issued in German Application No. 10 2016 006 967.8 dated Feb. 7, 2017 (5 pages).

* cited by examiner

HEAT EXCHANGER TUBE

The present invention relates to a heat exchanger tube having axially parallel or helically circumferential continuous fins formed from the tube wall on an outer tube face and/or on an inner tube face, continuously extending primary grooves formed between respectively adjacent fins, the fins having at least one structured region on the outer tube face and/or inner tube face, the structured region having a multiplicity of projections which project from the surface with a projection height, wherein adjacent projections are separated by notch formations.

BACKGROUND AND SUMMARY

Heat exchange occurs in many fields of refrigeration and air-conditioning technology as well as in processing and energy technology. In these fields, tubular bundle heat exchangers are frequently used to exchange heat. In many applications, a liquid, which is cooled or heated as a function of the direction of the heat flow, flows on the inner tube face. The heat is output to the medium located on the outer tube face or extracted therefrom.

It is generally known that, instead of smooth tubes, structured tubes are used in tubular bundle heat exchangers. The transfer of heat is improved by the structures. The heat flux density is increased by this and the heat exchanger can be constructed more compactly. Alternatively, the heat flux density can be retained and the driving temperature difference can be lowered, as a result of which heat exchange which is more efficient in terms of energy is possible.

Heat exchanger tubes which are structured on one face or both faces for tubular bundle heat exchangers usually have at least one structured region and smooth end pieces and possibly smooth intermediate pieces. The smooth end pieces or intermediate pieces bound the structured regions. So that the tube can be easily installed in the tubular bundle heat exchanger, the outer diameter of the structured regions should not be larger than the outer diameter of the smooth end pieces and intermediate pieces.

Integrally rolled fin tubes are frequently used as structured heat exchanger tubes. Integrally rolled fin tubes are understood to be finned tubes in which the fins have been formed from the material of the wall of a smooth tube. In many cases, fin tubes have a multiplicity of axially parallel or helically circumferential fins on the inner tube face which make the inner surface larger and improve the heat transfer coefficient on the inner tube face. On the outer face, the fin tubes have fins which run around in an annular or helical shape.

In the past, depending on the application, many possible ways were developed of increasing further the heat transfer on the outer face of integrally rolled fin tubes by providing the fins with further structure features on the outer tube face. As is known, for example, from U.S. Pat. No. 5,775,411, when condensation of refrigerants occurs on the outer tube face, the heat transfer coefficient is significantly increased if the fin sides are provided with additional convex edges. When refrigerants on the outer tube face evaporate, it has been found to improve the efficiency to at least partially close the ducts located between the fins, with the result that cavities are produced which are connected to the surroundings by pores or slits. As is already known from numerous documents, such essentially closed ducts are produced by bending over or folding over the fin (U.S. Pat. Nos. 3,696,861, 5,054,548), by splitting and compressing the fin (DE 2 758 526 C2, U.S. Pat. No. 4,577,381) and by notching and compressing the fin (U.S. Pat. No. 4,660,630, EP 0 713 072 B1, U.S. Pat. No. 4,216,826).

The performance improvements mentioned above on the outer tube face result in the main part of the entire heat transfer resistance being moved to the inner tube face. This effect occurs, in particular, at low flow rates on the inner tube face, such as for example during partial load operation. In order to reduce the entire heat transfer resistance significantly, it is necessary to increase further the heat transfer coefficient on the inner tube face.

In order to increase the heat transfer of the inner tube face, the axially parallel or helically circumferential inner fins are provided with grooves, as described in documents DE 101 56 374 C1 and DE 10 2006 008 083 B4. It is significant here that as a result of the use of profiled rolling mandrels, which are disclosed here for generating the inner fins and grooves, the dimensions of the inner structure and the outer structure of the in pipe can be set independently of one another. As a result, the structures on the outer face and inner face can be adapted to the respective requirements and the tube can be shaped accordingly.

Against this background, the object of the present invention is to develop inner structures and outer structures of heat exchange tubes of the above-mentioned type in such a way that a further increase in performance is achieved compared to already known tubes.

The object is achieved as discussed below.

The invention includes a heat exchanger tube having a longitudinal tube axis, wherein axially parallel or helically circumferential continuous fins are formed from the tube wall on the outer tube face and/or inner tube face, continuously extending primary grooves are formed between respectively adjacent fins, the fins have at least one structured region on the outer tube face and/or inner tube face, and the structured region has a multiplicity of projections which project from the surface with a projection height, as result of which the projections are separated by notch formations. According to the invention, the projections are arranged in groups which repeat periodically along the fin profile. In addition, at least two notch formations are formed between the projections within the group with a changing notch depth in one fin.

The structured region can in principle be formed here on the outer tube face or the inner tube face. However, it is preferred to arrange the fin sections according to the invention in the interior of the tube. The described structures can be used both for evaporator tubes and for condenser tubes.

The projection height is expediently defined as the dimension of a projection in the radial direction. The projection height is then the distance starting from the tube wall as far as the location on the projection which is furthest away from the tube wall in the radial direction.

The notch depth is the section measured in the radial direction starting from the original fin tip as far as the deepest point of the notch. In other words: The notch depth is the difference between the original fin height and the residual fin height remaining at the deepest point of a notch.

A changing notch depth is also equivalent to the respective deepest location of the notches alternating and consequently changing the distance from the tube wall. It is also equivalent to this that the respectively deepest point of the notches—here referred to as notch base—alternates in the distance from the longitudinal tube axis over successive notches in the direction of the fins.

The invention is based here on the idea that a different notch depth results essentially in a different height, orientation and shape of the projections from one another. The projections consequently deviate from a regulated order. This results, in turn in an optimized heat transfer with the lowest possible pressure loss during the single-phase flow, since the fluid boundary layer, which impedes a good heat transfer, is interrupted by additionally produced turbulence.

Compared with a uniformly homogenous arrangement of the projections, this targeted interruption of the boundary layer has a particularly positive effect on the heat transfer coefficient. The shapes, heights and arrangement of the projections can be adapted by setting suitable cutting blades or cutting geometries and by individually adapted fin shapes and geometries.

On the other hand, in the laminar flow region, the projections cause irregular dipping into the laminar flow core and therefore optimized conduction of heat from the tube wall into the laminar flow core and from the laminar flow core to the tube wall. These optimizations for the turbulent and laminar flow form are implemented by the different cutting depths and orientation of the projections according to the solution according to the invention.

The notch formations which are adjacent at least by one projection vary advantageously by at least 10% in the notch depth. The variation of the notch depth can more preferably be at least 20% or even 50%. As a result, projections of different heights are obtained, which in turn bring about an interruption of the boundary layer and an increase in turbulence and therefore an increase in the heat transfer coefficient.

In one advantageous embodiment of the invention, the greatest notch depth can extend at maximum as far as the tube wall. This results in an interruption of the boundary layer and therefore an increase in turbulence. This brings about an increase in the heat transfer coefficient. Notch formations extending into the tube wall are rather disadvantageous and can bring about an undesired weakening of the material in the tube wall, without on the other hand having a significantly further positive effect on the heat transfer coefficient.

In one preferred refinement of the invention, the notch formations are formed between primary grooves by making cuts into the inner fins at a cutting depth transversely with respect to the fin profile to form fin segments and by raising the fin segments in a main orientation along the fin profile.

The method-related structuring of the heat exchanger tube according to the invention can be brought about by using a tool which is already described in DE 603 17 506 T2. The disclosure of this document DE 603 17 506 T2 is included fully in the present documents. As a result, the projection height and the distance can be configured variably and adapted individually with respect to the requirements, for example the viscosity of the liquid or the flow rate.

The tool which is used has a cutting edge for cutting through the fins on the inner surface of the tube in order to produce fin segments and a lifting edge for lifting the fin segments to form the projections. In this way, the projections are formed without removing metal from the inner surface of the tube. The projections on the inner surface of the tube can be formed in the same processing step or a different processing step to the formation of the fins.

As a result, the projection height and distance can be configured in a variable fashion and adapted individually to the requirements of the fluid in question, for example in terms of the viscosity of the fluid and the flow rate.

In one advantageous embodiment of the invention, at least one projection can protrude from the main orientation along the fin profile over the primary groove. This provides the advantage that the boundary layer which is formed is interrupted in the intermediate space between the fins by this projection which projects into the primary groove, which brings about an improved transfer of heat.

The sub-section of the fin is advantageously present unchanged between the groups. Further positive influences on the heat transfer as result of the interruption of the boundary layer can be derived from the fact that different sub-divisions/groupings and alternately changing fin forms amplify the effects described above.

In one preferred embodiment of the invention, a plurality of projections can have a surface parallel to the longitudinal tube axis at the location furthest away from the tube wall.

In one particularly preferred embodiment, the projections can vary with respect to one another in terms of projection height, shape and orientation. As a result, the individual projections can be adapted selectively and can vary with respect to one another so that therefore, in the case of laminar flow, they dip, as a result of different fin heights, into the different boundary layers of the flow in order to divert the heat to the tube wall. The projection height and the spacing can therefore also be individually adapted to the requirements, e.g. viscosity of the fluid, flow rate etc.

In a further advantageous refinement of the invention, a projection can have a tip, running to a point, at the face facing away from the tube wall. This brings about optimized condensation at the tip in the case of condenser tubes using two-phase fluids.

In a further advantageous refinement of the invention, a projection can have, on the face facing away from the tube wall, a curved tip whose local curvature radius is decreased starting from the tube wall as the distance increases. This has the advantage that the condensate which is produced at the tip of a projection is transported more quickly to the fin foot as a result of the convex curvature, and the transfer of heat is therefore optimized when liquefaction occurs. At the phase change, here specifically when liquefaction occurs, the emphasis is on the liquefaction of the vapor and the conduction away of the condensate from the tip to the fin foot. A convex curved projection forms an ideal basis for the effective transfer of heat for this. The basis of the projection protrudes essentially radially from the tube wall here.

In one advantageous refinement of the invention, the projections can have a different shape and/or height from the start of a tube along the longitudinal tube axis as far as the end of the tube located opposite. The advantage here is targeted setting of the heat transfer from the start of the tube to the end of the tube.

The tips of at least two projections can advantageously be in contact with one another or cross over one another along the fin profile, which is advantageous specifically during the phase change in the reversible operating mode, since the projections project far out of the condensate for the liquefaction and form a type of cavity for the evaporation.

In one preferred embodiment of the invention, the tips of at least two projections are in contact with one another or cross over one another over the primary groove. This is in turn advantageous during the phase change in the reversible operating mode since the projections project far out of the condensate for the liquefaction and form a type of cavity for the evaporation.

In one particularly preferred embodiment, at least one of the projections can be shaped in such a way that its tip is in contact with the inner tube face or the outer tube face. In particular during the phase change in the reversible operating mode this is advantageous since the projections for the liquefaction form a type of cavity for the evaporation and therefore form bubble nucleation points. This brings about increased heat transfer coefficients during the evaporation process.

Exemplary embodiments of the invention are explained in more detail below with reference to the schematic drawings.

BRIEF DESCRIPTION OF THE DRAWINGS

In the drawings.

Mutually corresponding parts are provided in all figures with the same reference signs.

DETAILED DESCRIPTION

Figure 1:
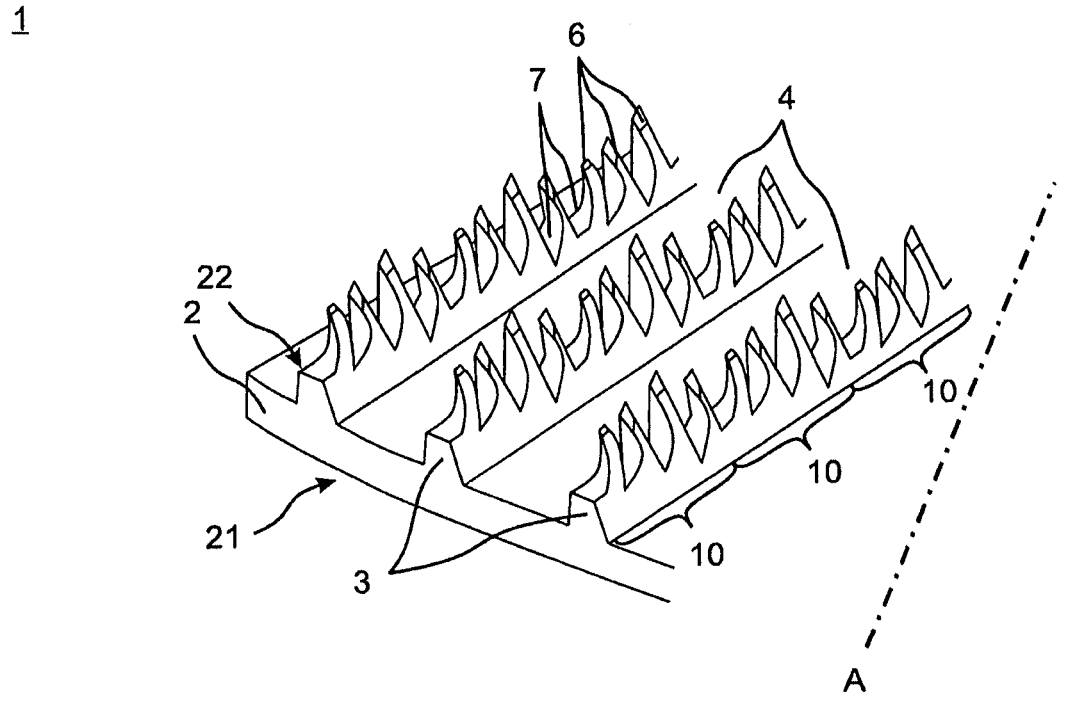
FIG. 1 shows a schematic, oblique view of a detail of the tube with the inventive structure on the inner tube face.

FIG. 1 is a schematic, oblique view of a tube detail of the heat exchanger tube 1 with the inventive structure on the inner tube face 22. The heat exchanger tube 1 has a tube wall 2, an outer tube face 21 and an inner tube face 22. Helically circumferential continuous fins 3 are formed from the tube wall 2 on the inner tube face 22. The longitudinal tube axis A runs at a certain angle with respect to the fins 3. Continuously extending primary grooves 4 are formed between respectively adjacent fins 3.

The projections 6 are formed in groups 10 which repeat periodically along the fin profile. The projections 6 are formed between primary grooves 4 by making cuts into the fins 3 at a cutting depth transversely with respect to the fin profile to form fin segments and by raising the fin segments in a main orientation along the fin profile. The notch formations 7 are formed between the projections 6 within the group 10 with a changing notch depth in one fin 3.

Figure 2:
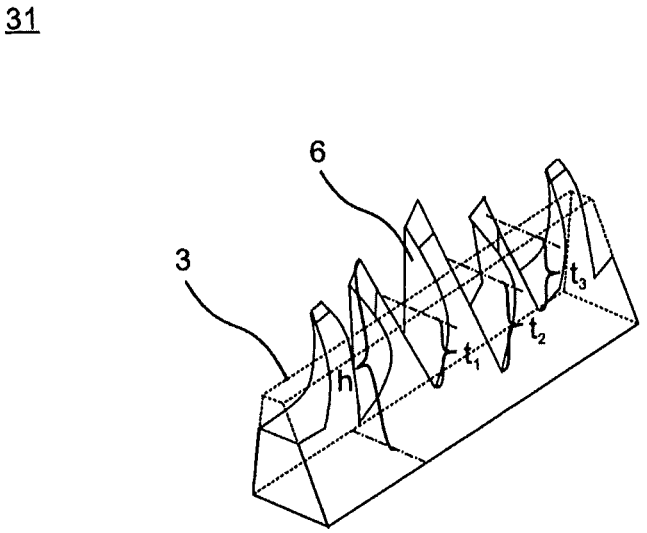
FIG. 2 shows a schematic view of a fin section with a different notch depth.

FIG. 2 shows a schematic view of a fin section 31 with a different cutting depth or notch depth $t_1$, $t_2$, $t_3$. The terms cutting depth and notch depth express the same concept within the scope of the invention. The projections 6 have alternately changing notch depths $t_1$, $t_2$, $t_3$ by means of a fin 3. The original, shaped helically circumferential fin 3 is indicated by dashed lines in FIG. 2. The projections 6 are formed from said fin 3 by making cuts into the fin 3 at a notch/cutting depth $t_1$, $t_2$, $t_3$ transversely with respect to the fin profile to form fin segments and by raising the fin segments in a main orientation along the fin profile. The different notch/cutting depths $t_1$, $t_2$, $t_3$ are consequently measured at the notch depth of the original fin in the radial direction.

The projection height h is expediently defined in FIG. 2 as the dimension of a projection in the radial direction. The projection height h is then the distance starting from the tube wall as far as the point on the projection which is furthest away from the tube wall in the radial direction.

The notch depth $t_1$, $t_2$, $t_3$ is the distance measured in the radial direction starting from the original fin tip as far as the deepest point of the notch. In other words: The notch depth is the difference between the original fin height and the residual fin height remaining at the deepest point of a notch.

Figure 3:
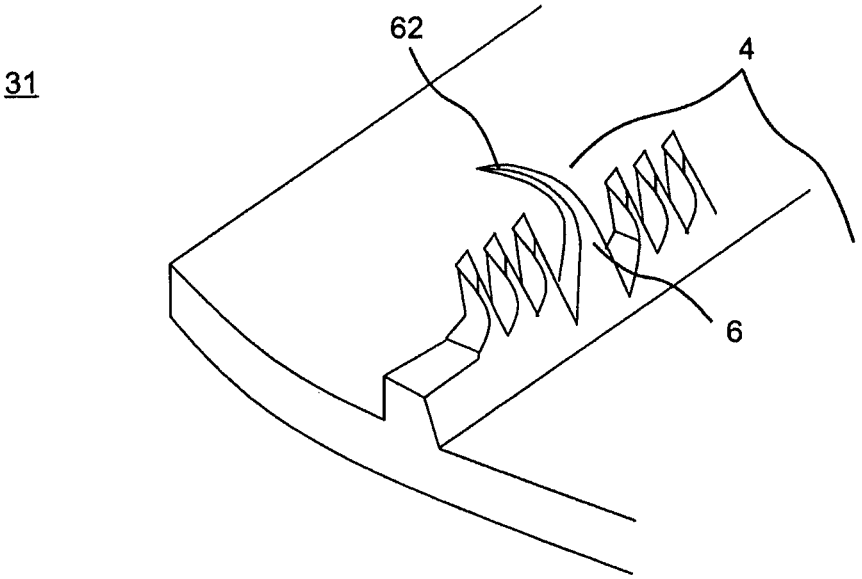
FIG. 3 shows a schematic view of a fin section with a structure element which protrudes over the primary groove.

FIG. 3 shows a schematic view of a fin section 31 with a structure element 6 which protrudes over the primary groove 4. This is a projection 6 which extends along the fin profile from the main orientation with the tip 62 over the primary groove 4. The wider the protrusion is made, the more intensive the disruption of the boundary layer of the fluid which is formed in the fin intermediate space, which brings about improved heat transfer.

Figure 4:
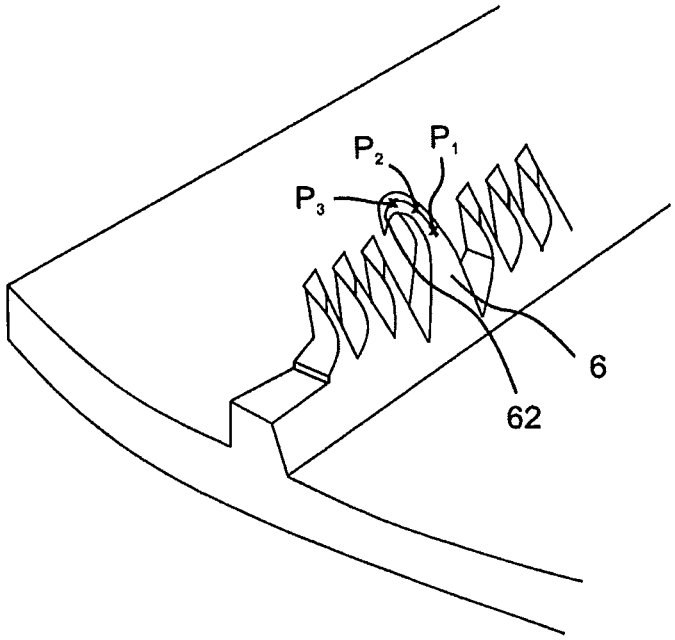
FIG. 4 shows a schematic view of a fin section with a projection on the tip which is curved in the fin direction.

FIG. 4 shows a schematic view of a fin section 31 with a projection 6 which is curved at the tip 62 in the direction of the fin. The projection 6 has a changing curvature profile at the curved tip 62. In this context, the local curvature radius decreases starting from the tube wall as the distance increases. In other words: The curvature radius becomes smaller along the line leading to the tip indicated by the points P1, P2, P3. This has the advantage that the condensate which is produced at the tip 62 in the case of two-phase fluids is transported more quickly to the fin foot by the increasing convex curvature. This optimizes the heat transfer when liquefaction occurs.

Figure 5:
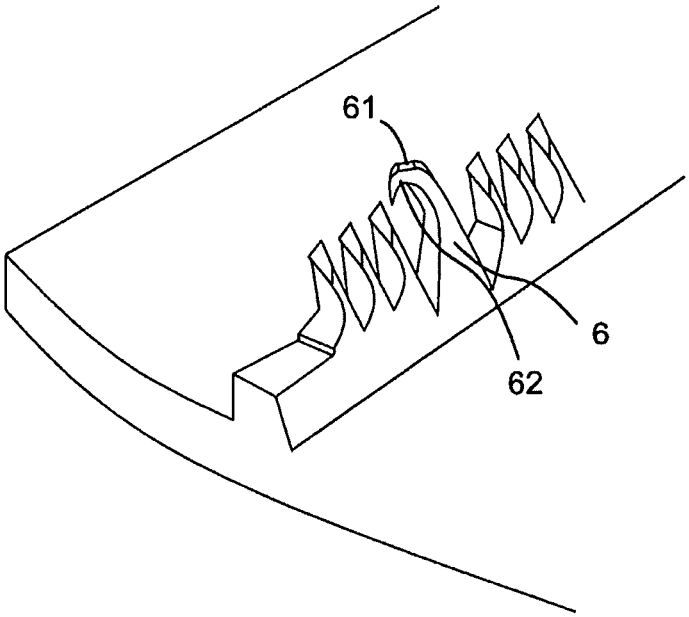
FIG. 5 shows a schematic view of a fin section with a projection with a parallel surface at the location furthest away from the tube wall.

FIG. 5 shows a schematic view of a fin section 31 with a projection 6 with a parallel surface 61 at the location which is furthest away from the tube wall, in the region of the tip 62.

The fin sections 31 which are illustrated in FIGS. 3 to 5 can be integrated individually or else in large numbers into the respective groups.

Figure 6:
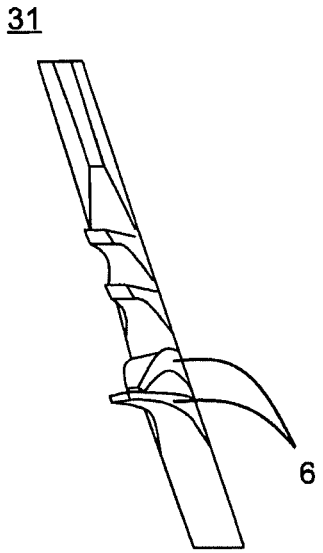
FIG. 6 shows a schematic view of a fin section with two projections which are in contact with one another along the fin profile.
Figure 7:
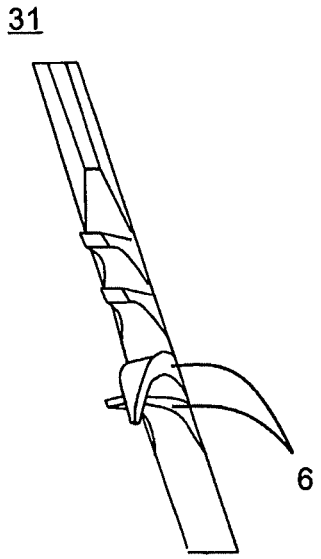
FIG. 7 shows a schematic view of a fin section with two projections which cross over one another along the fin profile.
Figure 8:
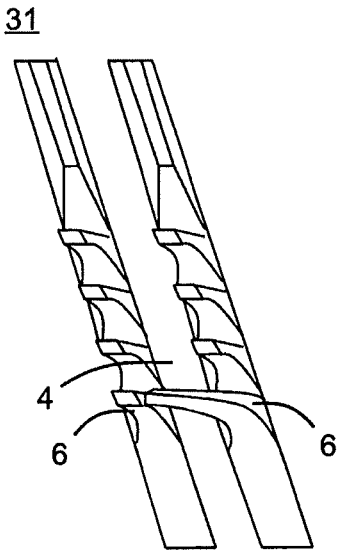
FIG. 8 shows a schematic view of a fin section with two projections which are in contact with one another over the primary groove.
Figure 9:
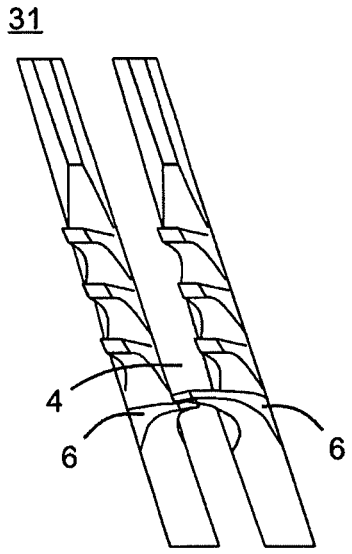
FIG. 9 shows a schematic view of a fin section with two projections which cross over one another over the primary groove.

FIG. 6 shows a schematic view of a fin section 31 with two projections 6 which are in contact with one another along the fin profile. Furthermore, FIG. 7 shows a schematic view of a fin section 31 with two projections 6 which cross over one another along the fin profile. FIG. 8 also shows a schematic view of a fin section 31 with two projections which are in contact with one another over the primary groove 4. FIG. 9 shows a schematic view of a fin section 31 with two projections 6 which cross over one another over the primary groove 4.

With the structure elements illustrated in FIGS. 6 to 9, it is advantageous, specifically in the reversible operating mode with two-phase fluids, that they form a type of cavity for the evaporation. The cavities of this particular type form the starting points for bubble nuclei of an evaporating fluid.

The invention claimed is:

1. A heat exchanger tube having a longitudinal tube axis, the heat exchanger tube comprising:

a tube wall, an outer tube face and an inner tube face;

axially parallel or helically circumferential fins disposed on at least one of the outer tube face or the inner tube face, the fins being formed from the tube wall and extending longitudinally and continuously along the tube wall;

continuously extending primary grooves formed between respectively adjacent fins;

the fins having at least one structured region on the at least one outer tube face or inner tube face, each structured region having a multiplicity of projections which project from the at least one outer tube face or inner tube face with a projection height, wherein adjacent projections are separated by notch formations and each notch formation has a notch depth;

the projections being arranged in groups, the groups periodically repeating longitudinally along the respective fin; and each group including at least two notch formations with notch depths different from one another, each of the two notch formations being disposed between two adjacent projections within the respective group.

2. The heat exchanger tube as claimed in claim 1, wherein the notch depth of the two notch formations vary from one another by at least 10%.

3. The heat exchanger tube as claimed in claim 1, wherein a maximum notch depth extends at as far as the tube wall.

4. The heat exchanger tube as claimed in claim 1, wherein the notch formations are formed between the primary grooves by making cuts into the fins at a cutting depth transversely with respect to a longitudinal extent of the fin to form fin segments and by raising the fin segments in a main orientation along the longitudinal extent of the fin profile.

5. The heat exchanger tube as claimed in claim 4, wherein at least one of the projections of each group protrudes from the main orientation over an adjacent one of the primary grooves.

6. The heat exchanger tube as claimed in claim 1, wherein a sub-section of the fin is unchanged between the groups.

7. The heat exchanger tube as claimed in claim 1, wherein some of the projections have a surface parallel to the longitudinal tube axis at a location furthest away from the tube wall.

8. The heat exchanger tube as claimed in claim 1, wherein the projections vary with respect to one another in projection height, shape and orientation.

9. The heat exchanger tube as claimed in claim 1, wherein at least one of the projections has a face facing away from the tube wall and a tip running to a pointy at the face.

10. The heat exchanger tube as claimed in claim 1, wherein at least one of the projections has a face facing away from the tube wall and a curved tip on the face, the curved tip having a local curvature radius which decreases starting from the tube wall as a distance from the tube wall increases.

11. The heat exchanger tube as claimed in claim 1, wherein the projections have at least one of a different shape or a different height from a start of the tube along the longitudinal tube axis as far as an end of the tube located opposite the start thereof.

12. The heat exchanger tube as claimed in claim 1, wherein tips of at least two of the projections are in contact with one another or cross over one another along a longitudinal extent of the respective fin.

13. The heat exchanger tube as claimed in claim 1, wherein tips of at least two of the projections are in contact with one another or cross over one another over an adjacent one of the primary grooves.

14. The heat exchanger tube as claimed in claim 1, wherein at least one of the projections has a tip which is shaped such that the tip is in contact with the at least one outer tube face or inner tube face.

15. The heat exchanger tube as claimed in claim 1, wherein each notch formation comprises a cut-out area of the respective fin extending transversely with respect to a longitudinal extent thereof.

16. A heat exchanger tube having a longitudinal tube axis, the heat exchanger tube comprising:

a tube wall, an outer tube face and an inner tube face facing away from the outer tube face;

a plurality of elongate fins formed from the tube wall and extending circumferentially continuously along at least one of the outer tube face or the inner tube face; and a plurality of elongate grooves extending continuously along the tube wall, each groove extending between two adjacent fins;

each fin having at least one structured region, the structured region including a plurality of projections disposed one after another along a longitudinal extent of the fin, each adjacent pair of projections being separated from one another by a notch formation comprising a cut-out area of the respective fin extending transversely with respect to the longitudinal extent thereof, the projections extending outwardly from the at least one outer tube face or inner tube face such that each projection has a projection height, the projections being arranged in groups one after another in a periodically repeating manner along the longitudinal extent of the respective fin, at least two of the notch formations located within each group having respective notch depths which are different from one another.

* * * * *